United States Patent [19]

Giggard

[11] Patent Number: 4,775,071

[45] Date of Patent: Oct. 4, 1988

[54] STRENGTH AEROSOL DOME

[75] Inventor: Earl D. Giggard, Clarendon Hills, Ill.

[73] Assignee: Continental Can Company, Inc., Norwalk, Conn.

[21] Appl. No.: 531,313

[22] Filed: Sep. 12, 1983

[51] Int. Cl.[4] ..... B65D 8/06

[52] U.S. Cl. ..... 220/67

[58] Field of Search ..... 220/66, 67, 73, 74, 220/1 BC; 222/394, 399

[56] References Cited

U.S. PATENT DOCUMENTS

| | | | |
|---|---|---|---|
| 272,921 | 2/1883 | Tuckett | 220/67 |
| 700,576 | 5/1902 | Thompson | 220/67 |
| 2,089,185 | 8/1937 | Colvin | 220/67 X |
| 2,322,843 | 6/1943 | Deane . | |
| 2,426,550 | 8/1947 | Coyle | 220/1 BC |
| 2,553,559 | 5/1951 | Eckman . | |
| 2,771,213 | 11/1956 | Lewis | 220/67 X |
| 2,775,372 | 12/1956 | Jordan . | |
| 3,080,989 | 3/1963 | Ramsbotham | 222/394 X |
| 3,416,702 | 12/1968 | Hoenig . | |
| 3,700,136 | 10/1972 | Ruekberg | 220/66 X |
| 3,921,848 | 11/1975 | Dolveck . | |
| 3,942,673 | 3/1976 | Lyu et al. | 220/66 |
| 3,987,927 | 10/1976 | Serr et al. . | |
| 4,093,102 | 6/1978 | Kraska | 220/66 X |
| 4,106,659 | 8/1978 | Dent et al. | 220/67 |
| 4,361,246 | 11/1982 | Nelson . | |

FOREIGN PATENT DOCUMENTS

| | | | |
|---|---|---|---|
| 11925 | 1/1903 | Austria . | |
| 415933 | 7/1925 | Fed. Rep. of Germany . | |
| 172434 | 10/1934 | Switzerland | 220/66 |

OTHER PUBLICATIONS

Reinforcing Ring Construction for Metal Barrels.

*Primary Examiner*—Henry J. Recla
*Assistant Examiner*—Robert M. Petrik
*Attorney, Agent, or Firm*—Charles E. Brown; Charles A. Brown; Paul Shapiro

[57] ABSTRACT

This relates to an improved aerosol container of the type wherein the dome is formed separately from the body and is secured to the body by a conventional double seam. The aerosol container is improved by squeezing the double seam radially inwardly so that it is, in effect, necked in and may also be tilted to correspond generally to the dome profile. In the ultimate condition the upper part of the body is also tilted radially inwardly and the chuck wall upper portion contacts the dome above the annular countersink completely to close the countersink. The container need not be an aerosol container, but may beneficially have not only the double seam joining the top end to the body radially inwardly offset or necked-in, but also if the bottom of the container is separately formed from the body, the double seam joining the bottom to the body should also be radially inwardly offset or necked-in so that bodies of adjacent containers may be in touching relation, thus requiring less material for a container and at the same time assuring a tight package. This abstract forms no part of the specification of this application and is not to be construed as limiting the claims of the application.

10 Claims, 1 Drawing Sheet

STRENGTH AEROSOL DOME

This invention relates in general to new and useful improvements in containers wherein ends are secured to bodies utilizing double seams. This invention, while it is of general usage, is particularly applicable to aerosol containers.

In years past, containers were of a three-piece construction with the top and bottom end units being secured to the tubular body by means of double seams which project beyond the periphery of the body. This has always posed a problem in the packaging of such containers in a wraparound carton type of enclosure in that if adjacent containers shift axially relative to one another, the double seams will ride past each other, thereby reducing the effective diameter of the containers and resulting in a loose package.

In recent years, containers for beer and soft drinks have been of a two-piece construction where the bottom is integral with the body and the body is necked-in to receive a smaller diameter top end unit. Thus, the packaging problems of the past have been eliminated for these types of containers.

There are, however, still in the marketplace containers, particularly aerosol containers, wherein at least one end is secured to the body by way of a double seam. With respect to one aspect of this invention, it has been found that if the double seams of a container are squeezed or otherwise deformed radially inwardly so as to lie entirely within the outline of the body, previous packaging problems as described above are eliminated.

Further, it has been found that the inward deformation of the double seam joining an aerosol dome to the body has beneficial strengthening results.

A standard aerosol container wherein the body and dome are separately formed is secured together by a conventional double seam. The double seam includes a chuck wall against which a supporting chuck must engage in order to support the abutting cylindrical portion of the dome and the container body during the folding of the flange portions of the dome and body to form the double seam. The net result is that the outer peripheral part of the dome must be provided with an annular countersink. This countersink weakens the dome thereof, and in the past it has been advantageously utilized to receive the lower end of an overcap.

When the dome is formed from a lighter gauge plate, buckling resistance problems occur in the area of the annular countersink. It has been found, however, that in accordance with this invention, if, after the dome is secured to the body, the double seam is reformed by squeezing the double seam radially inwardly and tilting the same so as to overlie the annular countersink and beneficially bringing the double seam into engagement with the dome radially inwardly of the annular countersink, the buckling resistance of the dome greatly increases.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
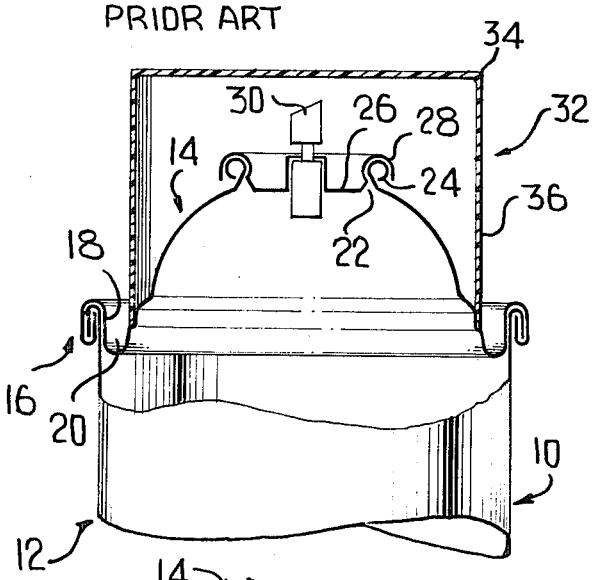
FIG. 1 PRIOR ART
FIG. 1 is a fragmentary vertical sectional view taken through the upper part of a conventional serosol container and overcap.

Referring now to the drawings in detail, it will be seen that there is illustrated in FIG. 1 a standard aerosol container generally identified by the numeral 10. The container 10 includes a container body 12 which may or may not have an integral bottom (not shown). The container body 12, as formed, has an open top or upper end, and this is closed by a conventional dome, generally identified by the numeral 14. The dome 14 is secured to the body 12 by way of a conventional double seam 16.

It is to be understood that in order for the double seam 16 to be formed, the telescoped portions of the dome and the body must be supported by a conventional seaming chuck. Thus, the dome must have as a part of the double seam a chuck wall 18 which may be engaged by the seaming chuck. In order to provide the chuck wall 18 with clearance for the seaming chuck, it is necessary that the dome 14 be axially inwardly offset adjacent the chuck wall 18, thus defining an annular countersink 20.

The required provision of the annular countersink 20 greatly reduces the buckling resistance of the dome 14 and has, in the past, required that the dome 14 be formed of thicker gauge metal than would otherwise be necessary to maintain the preselected internal pressure to which the aerosol container 10 is exposed.

In order further to describe the standard aerosol container, it is to be noted that the top part of the dome 14 is provided with a central opening 22 defined by an out-turned collar or curl 24. A valve cup 26 is seated in the opening and is provided with an annular portion 28 which interlocks and seals with the collar 24. The valve cup 26 carries the usual dispensing valve 30.

Aerosol containers are conventionally provided with an overcap such as the overcap 32. The overcap 32 is of a cup-shaped configuration and includes an end wall 34 having depending therefrom a skirt 36 which has its lower end locked generally within the countersink 20.

At this time it is pointed out that the illustrated countersink 20 has a lower portion which is narrower than an upper portion 38 and wherein, between the lower and upper portions, there is a shoulder 40 against which the lower end of the skirt 36 may seat. The exact details of the interlock of the skirt 36 with the dome 14 is not material as far as this invention is concerned.

Figure 3:
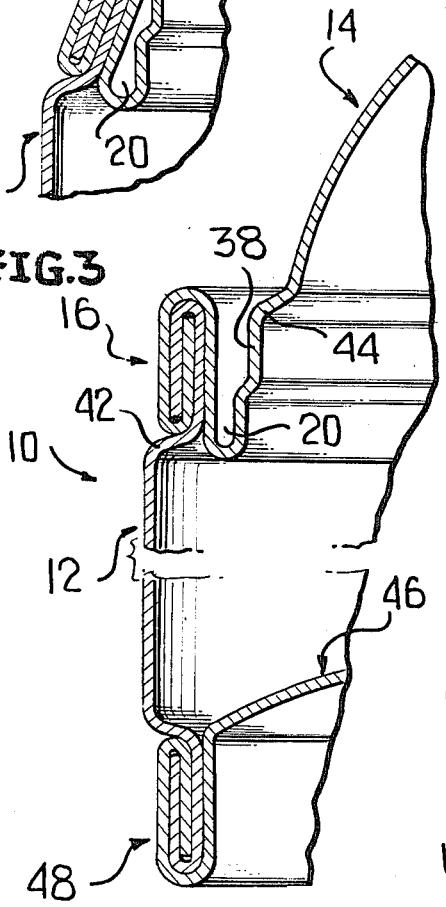
FIG. 3 is an enlarged fragmentary vertical sectional view with parts broken away of an aerosol container similar to that of FIG. 2 having a separate bottom end and wherein both double seams are radially inwardly displaced in accordance with this invention.

In accordance with this invention, utilizing suitable reforming tooling, after the dome 14 has been secured to the body 12 by means of the double seam 16, the double seam 16 is radially inwardly deformed or necked-in so that all portions of the double seam 16 are disposed radially inwardly of the body 12, as shown in the upper half of FIG. 3. The double seam 16 may thus be said to overlie a radially outer part of the countersink 20 by effectively reducing the radial dimension of the countersink. The net result is that an upper portion 42 of the body 12 is also displaced radially inwardly.

Significant strength improvement has been demonstrated with the double seam 16 radially inwardly displaced as shown in FIG. 3. However, if complete seam reduction is achieved as shown in FIG. 5 wherein the double seam 16 completely closes the countersink 20 and engages the dome profile as at 44, maximum strength improvement is obtained.

Figure 5:
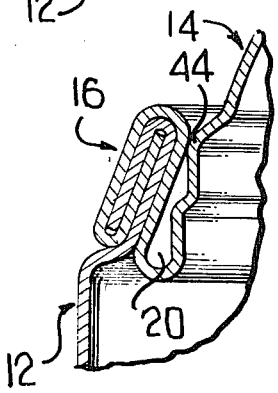
FIG. 5 is an enlarged fragmentary sectional view taken through a modified deformation of the double seam.

It has been found that there is an increased internal pressure resistance of the modified dome and double seam arrangements of FIGS. 3 and 5 which will permit the use of lighter gauge stock for the formation of the dome 14. It is believed that the increased internal pressure resistance is provided by:

1. A change in leverage applied to the countersink area through internal pressure by providing a negative countersink wall angle, as shown in FIG. 5.

2. A reduction in radius of the unit at the bottom of the countersink area, as shown in FIGS. 3 and 5.

3. In the utlimate structure where the seam upper portion bears against the dome, a physical backup or restraint by the reduced diameter double seam.

Figure 2:
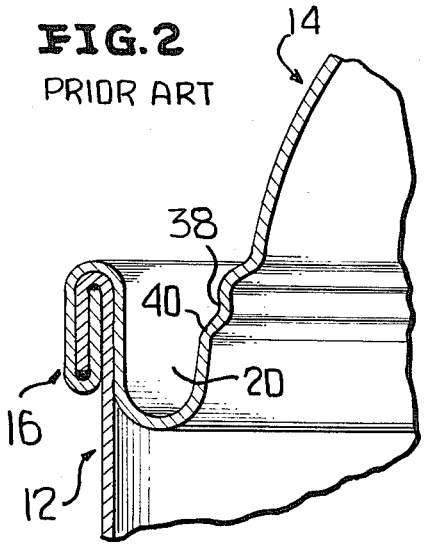
FIG. 2 PRIOR ART
FIG. 2 is an enlarged fragmentary vertical sectional view of the container of FIG. 1, without the overcap, and showing the specifics of the connection between the body and the dome.

The necking in of the double seam 16, as shown in FIG. 3, with or without the additional tilting as shown in FIG. 5, also has the benefit of the double seam being recessed within the outline of the body 12 to provide for a tighter package of a plurality of containers. As pointed out above, the body 12 may or may not have an integral bottom. In the lower portion of FIG. 1, the container 10 is illustrated with a separately formed bottom 46 which is secured to the body 12 by a second double seam 48. The double seam 48 is beneficially formed in a radially outwardly directed position similar to that of the double seam 16 in the prior art showings of FIGS. 1 and 2 and thereafter is squeezed or forced radially inwardly as in the case of the double seam 16.

The container 10 thus modified with all double seams disposed within the outline of the body 12, may be readily packaged in a wraparound container to form a permanent type package, while at the same time requiring less material for the container.

Figure 4:
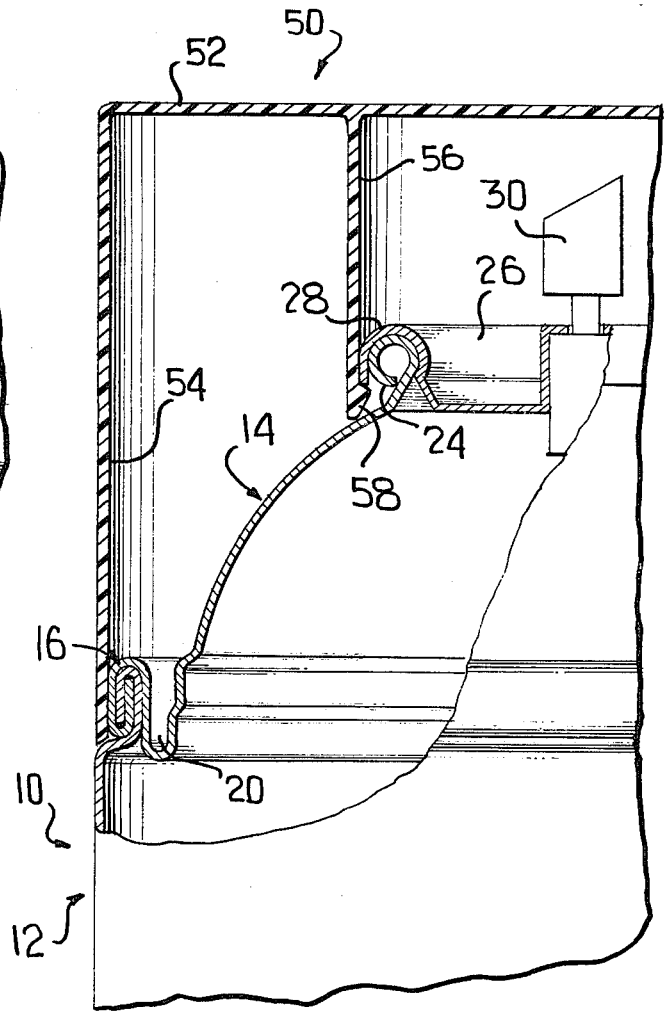
FIG. 4 is a vertical sectional view of the upper part of the modified aerosol container having attached thereto a different type of overcap.

When the double seam 16 is necked-in as shown in FIG. 3, or tilted as shown in FIG. 5, the overcap 32 may be replaced by an overcap 50 (FIG. 4) which may be of a conventional type. The overcap 50 has an end wall 52 and a depending skirt 54, the skirt 54 having an internal diameter corresponding to the outside diameter of the body 12.

The overcap 50 may be secured to the dome in one of two manners. At the present, overcaps of the type of which the overcap 50 is an example, are provided with an inner sleeve portion 56 with a lower radially inwardly directed enlargement 58 which interlocks beneath the annular portion 28 of the valve cup 26. On the other hand, it is feasible that the skirt 54 be provided at its lower end with a radially inwardly directed enlargement (not shown) which would lock below the lower part of the double seam 16.

Although only two preferred embodiments of the improved domed body double seam connection have been illustrated and described herein, it is to be understood that minor variations may be made in the container construction without departing from the spirit and scope of the invention as defined by the appended claims.

I claim:

1. An aerosol container of the type which in use is internally pressurized and includes a body having an open top closed by an aerosol dome secured to said body by a double seam having an originally formed position and a final position, and wherein said dome has as part of said double seam a chuck wall surrounding an annular countersink for receiving a seaming chuck, said aerosol container being improved by said double seam being reduced in diameter from said originally formed position to overlie said annular countersink in said final position, said body immediately adjacent to and below said double seam being also deformed radially inwardly with said double seam being in its entirety recessed within the outline of said body.

2. An aerosol container of the type which in use is internally pressurized and includes a body having an open top closed by an aerosol dome secured to said body by a double seam having an originally formed position and a final position, and wherein said dome has as part of said double seam a chuck wall surrounding an annular countersink for receiving a seaming chuck, said aerosol container being improved by said double seam being reduced in diameter from said originally formed position to overlie said annular countersink in said final position, said dome being formed of a lighter gauge metal and resisting pressurization to the same extent as a dome formed of a heavier gauge metal but lacking said reduced diameter double seam.

3. An aerosol container according to claim 1 wherein there is an overcap for said dome, said overcap having a skirt generally forming a continuation of said body.

4. A method improving the strength characteristics of a dome of an aerosol container wherein said container includes a body having an open top end closed by a dome secured to said body by a double seam, and wherein said dome has an annular countersink surrounding said double seam, said method comprising squeezing said double seam from an originally formed position radially inwardly to a final position overlying said annular countersink and thereby strengthen said dome, said double seam being caused to be tilted to said final position and positioned to contact said dome above and radially inwardly of said annular countersink, said body adjacent said double seam is also tilted radially inwardly to position said double seam radially inwardly of said body.

5. A method according to claim 4 wherein the squeezing of said double seam radially inwardly to said final position is primarily one of direct radial compression and said double seam is substantially cylindrical and coaxial with said body.

6. A container of the type comprising a body, a bottom end and a top end, and wherein at least one of said ends is formed separate and apart from said body and is secured to said body by a double seam projecting radially outwardly of said body in an original position, and all projecting double seams together within adjacent portions of said body and the respective end are radially inwardly offset in a final position with all double seams between said body and said ends lying within axial extensions of said body.

7. A container according to claim 6 wherein said container is an aerosol container, said top end is in the form of a dome having an annular countersink immediately radially inwardly of said double seam for receiving a seaming chuck, and said double seam between said dome and said body at least partially overlies said countersink.

8. A container according to claim 7 wherein said radially inwardly offset double seam is substantially coaxial with said body.

9. A container according to claim 7 wherein radially inwardly offset double seam is tilted radially inwardly and upwardly.

10. A container according to claim 7 wherein said end connected to said body by said double seam is said bottom end.

* * * * *